US006447883B1

(12) United States Patent
Chen et al.

(10) Patent No.: US 6,447,883 B1
(45) Date of Patent: Sep. 10, 2002

(54) INK-JET MEDIA HAVING HIGH AQUEOUS-BASED INK ABSORPTION CAPACITY

(75) Inventors: Tao Chen, Lincoln; Odette M. Glass, North Kingstown, both of RI (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/523,321

(22) Filed: Mar. 10, 2000

(51) Int. Cl.[7] ..... B41M 5/00

(52) U.S. Cl. ..... 428/195; 428/211; 428/331; 428/423

(58) Field of Search ..... 428/195, 207, 428/328–331, 423, 211

(56) References Cited

U.S. PATENT DOCUMENTS

| | | | | |
|---|---|---|---|---|
| 3,158,494 A | | 11/1964 | Eikvar et al. | 117/45 |
| 4,542,059 A | | 9/1985 | Toganoh et al. | 428/141 |
| 4,578,285 A | | 3/1986 | Viola | 427/209 |
| 4,642,247 A | * | 2/1987 | Mouri et al. | 427/214 |
| 4,770,934 A | | 9/1988 | Yamasaki et al. | 428/331 |
| 4,877,680 A | * | 10/1989 | Sakaki et al. | 428/332 |
| 5,120,601 A | * | 6/1992 | Kotaki et al. | 428/327 |
| 5,397,619 A | | 3/1995 | Kuroyama et al. | 428/141 |
| 5,605,750 A | | 2/1997 | Romano et al. | 428/304.4 |
| 5,616,409 A | | 4/1997 | Matsuda et al. | 428/323 |
| 5,679,451 A | | 10/1997 | Kondo et al. | 428/304.4 |
| 5,965,244 A | | 10/1999 | Tang et al. | 428/195 |

FOREIGN PATENT DOCUMENTS

| | | |
|---|---|---|
| JP | 10181189 A | 7/1998 |
| WO | WO 9720697 | 12/1996 |
| WO | WO 9816396 | 4/1998 |

* cited by examiner

*Primary Examiner*—Bruce H. Hess
(74) *Attorney, Agent, or Firm*—Birch, Stewart, Kolasch & Birch, LLP

(57) ABSTRACT

The present invention relates to ink-jet recording media having an ink-receptive coating comprising silica, water-dispersible alumina and a hydrophilic, water-insoluble polyurethane resin. The polyurethane resin is capable of absorbing at least 200% by weight of water. The media provide images having good color gamut, color density and water-fastness.

6 Claims, No Drawings

INK-JET MEDIA HAVING HIGH AQUEOUS-BASED INK ABSORPTION CAPACITY

BACKGROUND OF THE INVENTION

1. Field of the Invention

The present invention relates to ink-jet recording media having an ink-receptive coating comprising a hydrophilic, water-insoluble polyurethane resin, silica and water-dispersible alumina. The media are capable of absorbing large volumes of aqueous-based ink to provide images having good color gamut, color density and water-fastness.

2. Brief Description of the Related Art

Recently, it has become more popular to used wide format ink-jet printers for printing large format materials such as signs, posters, banners, and advertising displays for indoor and outdoor applications. Typically, the recording medium comprises a base substrate coated with an ink-receptive coating. If the printed image or text is intended for viewing by reflected light, the substrate is typically an opaque paper or film. If the printed image or text is intended for viewing by transmitted light, the substrate is typically a transparent or translucent film.

"Back-lit" films are typically translucent films, where the image (and text) is viewed by means of a light source placed behind the imaged surface of the films. Back-lit films are commonly used for high impact lighted signs, vending and game machine displays, and trade-show displays. For these applications, it is important that the substrate and coatings be durable and have good weather-resistance, particularly water-fastness and light stability.

Traditionally, most inks used in ink-jet printing devices have consisted of molecular dyes carried in an aqueous-based solvent or ink vehicle containing a substantial amount of water. Water-miscible solvents and trace amounts of high-boiling solvents such as glycol or glycol ethers may also be present in the fluid. During imaging (i.e., printing), molecular dyes from the ink penetrate into the ink-receptive coating, leaving solvent to evaporate off the surface of the imaged media. Today, pigmented inks are replacing molecular dye-based inks. Pigmented-based inks have better light stability than molecular dye-based inks which is important for imaged media that are displayed outdoors. Pigmented inks comprise a pigmented colorant carried in an aqueous-based ink vehicle. Unlike molecular dyes, pigmented colorants generally bind to the surface of the film or paper, i.e., recording medium. In order to obtain an image having good color gamut and high color density that does not smear, the recording medium should absorb the ink quickly, while retaining or insolubilizing the colorants on its surface.

The industry is constantly seeking to develop ink-jet recording media having improved ink-receptive coatings.

For example, Viola, U.S. Pat. No. 4,578,285 discloses a transparent ink-jet printing substrate comprising a transparent support carrying an ink-receptive layer comprising at least 70 weight percent polyurethane and 5 to 30 weight percent of a polymer selected from the group consisting of poly(vinyl pyrrolidone), vinyl pyrrolidone/vinyl acetate copolymer, poly(ethylene oxide), gelatin, and poly(acrylic acid). The patent further discloses that in order to prevent front-to-back blocking of the printing substrates and to improve slippage in the printer, the ink-receptive layer may contain about 0 to 0.5% by weight silica.

Romano et al., U.S. Pat. No. 5,605,750 discloses an opaque image-recording element for an ink-jet printer comprising an opaque substrate having on its surface a lower layer of a solvent-absorbing microporous material and an upper layer of a porous, pseudo-boehmite. The microporous layer comprises: (a) a matrix of a substantially water-insoluble thermoplastic organic polymer such as, for example, polyolefins, polyesters, polyamides, polyurethanes, polyureas, poly(vinyl halides), poly(vinylidene halides), polystyrenes, poly(vinyl esters), and polycarbonates; (b) finely divided substantially water-insoluble filler particles such as, for example, silica, mica, and clay; and (c) a network of interconnecting pores.

It would be desirable to have an ink-jet recording medium with an ink-receptive coating that could absorb large volumes of aqueous-based pigmented ink to form an image having good color gamut, color density and water-fastness. The present invention provides such ink-jet recording media.

SUMMARY OF THE INVENTION

The present invention relates to an ink-jet recording medium comprising a substrate having an ink-receptive layer coated thereon. The ink-receptive layer comprises silica, water-dispersible alumina and a hydrophilic, water-insoluble polyurethane resin capable of absorbing at least 200% by weight of water based on the weight of said resin. Preferably, the layer further comprises a metal salt.

Typically, the polyurethane resin comprises at least 25 wt. % the silica particulate comprises at least 25 wt. % and the water-dispersible alumina particulate comprises about 1 to about 10 wt. % of the layer based on the weight of the layer. Preferably, the layer comprises about 30 to about 60 wt. % polyurethane resin and about 30 to about 70 wt. % silica particulate.

Preferably, the silica particulate has a particle size in the range of about 4 to about 10 microns and a surface area of at least 300 $m^2/g$. Preferably, the water-dispersible alumina comprises at least 90 wt. % aluminum hydrate.

The substrate may be a paper or film. Translucent films are preferred for use as back-lit films.

DETAILED DESCRIPTION OF THE INVENTION

The present invention relates to an ink-jet recording medium comprising a substrate having an ink-receptive coating prepared from an aqueous-based solution.

The porous ink-receptive coating comprises a hydrophilic, water-insoluble polyurethane resin that is capable of absorbing at least 200% by weight water based on the weight of the resin.

Suitable hydrophilic, water-insoluble polyurethanes include, for example, carboxylated, polyester-type, and polyether-type polyurethanes that are capable of absorbing at least 200% by weight water. As shown in the following examples, it has been found that not all polyurethane resins are suitable for use in the present invention. Suitable polyurethanes may be in the form of a dispersion or solution having a solids content of about 20% or greater. Commercially-available suitable polyurethane resins include IJ-40 and IJ-150 available from Espirit Chemical Company (Sarasota, Fla.).

Silica particles useful in the present invention include amorphous precipitated silica and silica gel particles. The polyurethane resin may be filled with silica particulate, i.e., it may be commercially produced and sold with silica particulate dispersed within the resin. Alternatively, the silica particulate may be added to the ink-receptive coating formulations of this invention as a separate ingredient. Typically, the size of the silica particles is in the range of about 2 $\mu$m to about 15 $\mu$m. Preferably, the silica has a particle size of about 4 to about 10 $\mu$m and a surface area of at least 300 $m^2/g$. Suitable silica particles are commercially available, for example, GASIL IJ-35 silica gel available from Crossfield Company (Joilet, Ill.) may be used. Silica particles having relatively high surface areas should be used to enhance the ink absorption capabilities of the coating.

The ink-receptive coating further contains water-dispersible alumina to enhance image quality. The alumina also improves the strength and water-fastness of the coating. Preferably, the water-dispersible alumina comprises at least 90 wt. % aluminum hydrate. As shown in the following examples, when no water-dispersible alumina is present in the coating, the quality of the image is only fair with significant inter-color bleeding and ink cracking visible. Suitable water-dispersible alumina include DISPERAL SOL P2, available from CONDEA Vista Company (Houston, Tex.).

As shown in the following examples, it is important that the ink-receptive coating contain a polyurethane resin having a water-absorption capacity of at least 200 wt. %, silica and water-dispersible alumina in order to obtain high quality prints having good color gamut, color density and water-fastness.

Typically, the hydrophilic, water-insoluble polyurethane resin comprises at least about 25% by weight and is preferably about 30 to about 60 wt. % of the ink-receptive coating based on the weight of the coating. Typically, the silica comprises at least about 25% by weight and is preferably about 30 to about 70 wt. %. The alumina particulate comprises about 1 to about 10% by weight of the coating.

In addition, the ink-receptive coating may contain various polymeric binders for enhancing image quality. For example, water-soluble polymeric binders, such as poly(2-ethyl-2-oxazoline), poly(vinyl pyrrolidone), vinyl pyrrolidone copolymers, poly(ethylene oxide), starch, casein, sodium alginate, gelatin, gum arabic, and cellulose derivatives may be used. In addition, water-dispersible resins such as polyacrylates, polymethacrylates, polyvinyl acetate, polyvinyl chloride, styrene, styrene and maleic acid anhydride copolymers may be used. METHOCEL K3, a water-soluble cellulose ether available from Dow Chemical, is an example of a suitable cellulose derivative that can be used.

Various additives may also be employed in the ink-receptive coating. These additives include surface active agents that control the wetting or spreading action of the coating solution, antistatic agents, suspending agents, acidic compounds to control the pH of the coating, optical brighteners, UV blockers/stabilizers, and the like. In addition to the above-described silica particles, other particulate may be used, for example, alumina, kaolin, glass beads, calcium carbonate, titanium dioxide, polyolefins, polystyrene, starch, poly(methyl methacrylate), and poly (tetrafluoroethylene).

The ink-receptive coating can further include metal salts of the formula, MeX to improve ink absorption. The metal can be Na, K, Mg, Zn, Ca, Cu, and the like, and X can be Cl, Br, $SO_4$, and the like. The metal salt may be be used in an amount up to about 10% by weight based on the weight of the coating to enhance the ink capacity of the coating without harming coating strength.

The ink-receptive coating has a high void content due to the high concentration of silica dispersed in the polyurethane resin-based coating. The porous nature of the ink-receptive coating allows aqueous-based pigmented ink to penetrate the coating and be rapidly absorbed in the spaces between the silica. Further, the silica particles have a high surface area and are capable of absorbing the ink. In this manner, images having good smear and water-resistance are produced. At the same time, the pigmented colorants in the ink tend to bind to the coating at or near its surface, thereby providing an image having good color gamut and high color density.

The ink-jet recording media of this invention can be made using any suitable substrate such as a polymeric film or paper. Examples of suitable polymeric films include films made of polymers selected from the group consisting of polyesters, cellulose esters, polyimides, polystyrenes, polyolefins, poly(vinyl acetates), polycarbonates, and fluoropolymers, and mixtures thereof. Examples of suitable papers included plain papers, clay-coated papers, and resin-coated papers. Polyester and vinyl films are particularly preferred film substrates. Polyethylene-coated papers are particularly preferred paper substrates. The thickness of the base substrate may vary, but is typically in the range of about 1 mil to about 20 mils, and most typically in the range of about 3 to about 9 mils. The base substrate may be treated with a conventional adhesion promoting layer on its imaging surface as is known in the art. As discussed above, the ink jet recording media of this invention are particularly suitable for use as "back-lit" films.

Conventional coating and drying methods may be employed including roller coating, blade coating, wire bar coating, dip coating, extrusion coating, air knife coating, curtain coating, slide coating, doctor coating, gravure coating, or slot-die coating, and the coating may be dried by hot forced air in an oven.

The invention is further illustrated by the following examples using the below test methods, but these examples should not be construed as limiting the scope of the invention.

Test Methods

Color Density

The ink-jet recording media were imaged with multiple colors using HPUV ink from a HP 2500CP printer in D best mode, and the color density of the imaged medium was determined. The black pigment ink density (KOD) of the imaged surface was measured on a densitometer (Macbeth TD904 available from Macbeth Process Measurements, Newburgh, N.Y.) following the manufacturer's standard recommendations. Samples having high ink density values exhibit images having better quality and higher resolution than samples having low ink density values.

Water Absorption Capacity

A polyurethane resin was coated onto the surface of a polyester film and dried. A 3 inch by 4 inch sample of the coated film was then weighed ($W_0$). The film sample was then immersed in a tray of water for about twenty (20) minutes and then removed. A blotting paper was used to remove excess amounts of water from the film sample, and the wet film sample was weighed ($W_2$). The polyurethane coating was then removed from the wet film sample by scraping the sample with a sheet of paper, and the film was weighed ($W_1$).

The water absorption capacity of the polyurethane resin was determined according to the following formula:

$$A = \frac{W_2 - W_0}{W_0 - W_1}$$

Coating Strength

The strength of the ink-receptive coating on the substrate was evaluated in the following manner. A piece of scotch tape was placed firmly on a non-imaged medium and then quickly peeled off. The tape was then inspected to determine whether or not any coating residue was on the tape. For coatings having excellent strength, no coating residue, or only a minimal amount, was observed on the tape.

EXAMPLES

In the following examples, different polyurethane resins were used to prepare the below-described formulations which were coated onto polyester films. The formulations were applied to the film using a metering rod and dried in an oven at 120° C. for four (4) minutes.

The water-absorption capacity of the polyurethane resins were measured and the imaged media were evaluated. The results are reported below in the examples and Table 1.

Example 1

| Ingredient | Weight Percentage |
|---|---|
| IJ-40* | 44.6% |
| GASIL IJ-35** | 8.7% |
| DISPERAL SOL 2*** | 0.9% |
| Citric Acid | 0.1% |
| Water | 45.7% |

* IJ-40 is a hydrophilic water-insoluble polyurethane resin in the form of a dispersion containing about 20% solids available from Espirit Chemical Company. IJ-40 does not contain silica particulate. IJ-40 was determined to have a water-absorption capacity (A) of 220 wt. %.
** GASIL IJ-35 is a silica gel available from Crossfield Company (Joilet, IL).
***DISPERAL SOL 2 is a water-dispersible alumina available from CONDEA Vista Company (Houston, TX).

Example 2

| Ingredient | Weight Percentage |
|---|---|
| IJ-100* | 7.2% |
| IJ-150** | 71.6% |
| DISPERAL SOL 2 | 0.3% |
| METHOCEL K3*** | 0.2% |
| CHARTWELL B-515.1**** | 0.6% |
| Isopropyl Alcohol | 3.3% |
| Water | 16.8% |

*IJ-100 is a hydrophilic water-insoluble polyurethane resin containing silica particles in the form of an aqueous dispersion containing about 26% solids available from Espirit Chemical Company.
**IJ-150 is a hydrophilic water-insoluble polyurethane resin containing silica particles in the form of an aqueous dispersion containing about 20% solids available from Espirit Chemical Company. The resin of IJ-150 was determined to have a water-absorption capacity (A) of 1200 wt. %.
***METHOCEL K3 is a water-soluble hydroxypropyl methylcellulose available from Dow Chemical.
****CHARTWELL B-515.1 is an adhesion-promoter available from Chartwell International, Inc.

| Ingredient | Weight Percentage |
|---|---|
| IJ-100 | 7.2% |
| IJ-150 | 71.6% |
| DISPERAL SOL 2 | 0.3% |
| METHOCEL K3 | 0.2% |

-continued

| Ingredient | Weight Percentage |
|---|---|
| CHARTWELL B-515.1 | 0.6% |
| NaCl | 0.6% |
| Isopropyl Alcohol | 3.3% |
| Water | 16.2% |

Example 3

Example 4

| Ingredient | Weight Percentage |
|---|---|
| IJ-100 | 7.2% |
| IJ-150 | 71.6% |
| DISPERAL SOL 2 | 0.3% |
| METHOCEL K3 | 0.2% |
| CHARTWELL B-515.1 | 0.6% |
| MgSO4 | 0.6% |
| Isopropyl Alcohol | 3.3% |
| Water | 16.2% |

| Ingredient | Weight Percentage |
|---|---|
| SANCURE 1301* | 33.3% |
| GASIL IJ-35 | 11.2% |
| Water | 53.4% |

SANCURE 1301* is a polyurethane resin in the form of an aqueous dispersion having 40 wt. % solids available from B.F. Goodrich Company. SANCURE 1301 was determined to have a water-absorption capacity (A) of 2.1 wt. %.

| Ingredient | Weight Percentage |
|---|---|
| IJ-150 | 86.2% |
| METHOCEL K3 | 0.2% |
| Isopropyl Alcohol | 2.6% |
| Water | 11.0% |

The coating formulation in Comp. Ex. 2 did not contain any alumina.

TABLE 1

| Example | Image Quality | Color Density KOD | Coating Strength |
|---|---|---|---|
| 1 | Excellent | 3.20 | Excellent |
| 2 | Good (with slight bleeding together of some colors.) | 2.65 | Excellent |
| 3 | Excellent | 2.55 | Excellent |
| 4 | Excellent | 2.57 | Excellent |
| Comp. 1 | Poor - Image could not be printed. | Could not be measured. | Excellent |
| Comp. 2 | Fair (with severe ink bleeding and ink cracking in image.) | 3.00 | Good |

What is claimed is:

1. A weather-durable ink-jet recording medium comprising a substrate having a porous ink-receptive layer coated thereon, said layer capable of absorbing aqueous-based pigmented ink and comprising about 30 to about 70 wt. % silica particulate, about 1 to about 10 wt. % water-dispersible alumina, and about 30 to about 60 wt. % hydrophilic, water-insoluble polyurethane resin based on total dry weight of the coated layer, said polyurethane resin capable of absorbing at least 200% by weight of water based on the weight of said resin.

2. The ink-jet recording medium of claim 1, wherein the ink-receptive layer further comprises a metal salt.

3. The ink-jet recording medium of claim 1, wherein the silica particulate has a particle size in the range of about 4 to about 10 microns and a surface area of at least 400 $m^2/g$.

4. The ink-jet recording medium of claim 1, wherein the water-dispersible alumina comprises at least 90 wt. % aluminum hydrate.

5. The ink-jet recording medium of claim 1, wherein the substrate is a paper or film.

6. The ink-jet recording medium of claim 1, wherein the substrate is a translucent film.

* * * * *